US006382217B2

(12) United States Patent
Coker et al.

(10) Patent No.: US 6,382,217 B2
(45) Date of Patent: May 7, 2002

(54) PROCESS FOR FABRICATING CUSTOM FIT REMOVABLE AND REUSABLE METAL FINGERNAILS

(76) Inventors: Wade Coker; Denise Marie-Coker, both of 8741 E. Layton Ave., Denver, CO (US) 80207

( * ) Notice: Subject to any disclaimer, the term of this patent is extended or adjusted under 35 U.S.C. 154(b) by 0 days.

(21) Appl. No.: 09/827,430

(22) Filed: Apr. 6, 2001

Related U.S. Application Data

(60) Provisional application No. 60/195,059, filed on Apr. 6, 2000.

(51) Int. Cl.[7] ..... A45D 24/00
(52) U.S. Cl. ..... 132/200; 132/73; 132/285
(58) Field of Search ..... 132/200, 73, 285, 132/319, 320; 156/152, 424

(56) References Cited

U.S. PATENT DOCUMENTS 4,361,160 A * 11/1982 Bryce
4,661,187 A * 4/1987 Beasley
4,718,957 A * 1/1988 Sensenbrenner
4,779,632 A * 10/1988 Howa et al.
6,012,461 A * 1/2000 McKew

* cited by examiner

*Primary Examiner*—Pedro Philogene
(74) *Attorney, Agent, or Firm*—Edwin H. Crabtree; Ramon L. Pizarro; Donald W. Margolis

(57) ABSTRACT

A process for fabricating custom fit removable and reusable false metal fingernails. The steps include pouring impression material around the fingernail and nail bed and forming a negative finger impression of the fingernail and nail bed. The negative finger impression is now filled with an investment material for forming a positive investment impression of the fingernail and nail bed. An artificial plastic fingernail tip is now attached to the nail bed of the fingernail on the positive investment impression. Wax is now spread in the fingernail bed next to the cuticle for covering an area in the bed not covered by the plastic tip. One end of a wax sprue is now melted and attached to a center portion of the plastic fingernail tip. Another end of the wax sprue is inserted into a top of a rubber ring former. A metal ring with a ceramic liner in now placed on the ring former surrounding the wax sprue attached to the plastic finger tip, the fingernail pattern and the investment material are now placed inside an oven and heated up to 1200 degrees F. At this time, the plastic fingernail tip, the wax in the nail bed and the wax sprue are melted leaving a negative fingernail mold which is filled with a selected metal using a centrifugal force casting machine and forming a positive metal fingernail and metal sprue.

15 Claims, 2 Drawing Sheets

PROCESS FOR FABRICATING CUSTOM FIT REMOVABLE AND REUSABLE METAL FINGERNAILS

This application is based on a provisional patent application filed in the U.S. Patent and Trademark Office on Apr. 6, 2000 and having Ser. No. 60/195,059.

BACKGROUND OF THE INVENTION (a) Field of the Invention

This invention relates to the making and using of false fingernails and more particularly, but not by way of limitation, to a process and method of fabricating custom fit metal fingernails which are removable and reusable.

(b) Discussion of Prior Art

In U.S. Pat. No. 4,361,160 to Bryce, U.S. Pat. No. 3,037,514 to Lappe and U.S. Pat. No. 4,718,957 to Sensenbrenner, different method and systems are described for forming and creating artificial fingernails. None of these prior art patents specifically disclose or teach the unique features, objects and advantages of the subject process for making custom false fingernails made of various types of metals.

SUMMARY OF THE INVENTION

In view of the foregoing, it is a primary objective of the subject invention to provide a process for making false fingernails of metal which are easily removable and reusable.

Another object of the process is the false fingernails can be made of precious metals such as silver and gold. Also, the fingernails can be made of less expensive metal alloys.

Still another object of the invention is the subject process makes custom fit false fingernails for conforming to an individual's fingernail and fingernail bed. The process is used for making false fingernails for each of an individual's fingers.

The steps of the process described herein include first cleaning each fingernail and nail bed for removing natural oil. After the fingernail and nail bed have been cleaned and dried, a thermoplastic impression material is poured over and around the end of each finger and including the fingernail and nail bed. When the impression material has set-up, the finger is removed and a negative finger impression of the fingernail and nail bed has been created.

The negative finger impression is now filled with a high heat dental crown and bridge investment material or similar high heat material. When the investment material has dried, a positive investment impression of the fingernail and nail bed is removed from the negative finger impression.

An artificial plastic fingernail tip is now attached, using an adhesive, to the nail bed of the fingernail on the positive investment impression. The plastic fingernail tip is then trimmed and shaped according to the user's instructions. Wax is now spread and smoothed in the fingernail bed next to the cuticle for covering an area in the bed not covered by the plastic tip. An arbor ban is now used to remove excess investment material around the fingernail bed and the plastic fingernail tip.

One end of a lower stem of a wax sprue is now melted and attached to a center portion of the plastic fingernail tip. One end of the upper stem of the wax sprue is now inserted into a small opening in the top of a hollow dome shaped cap in a center of a rubber ring former. A metal ring with a ceramic liner in now placed on the ring former surrounding the cap and the wax sprue attached to the plastic finger tip, the fingernail pattern and the remaining investment material. Additional material is now poured inside the metal ring and the ceramic liner. When the investment material has set-up, the rubber ring former is removed from the metal ring leaving a cone shaped cavity formed by the dome shaped cap in an end of the investment material.

The metal ring with ceramic liner, the investment material with the plastic fingernail tip, the fingernail bed and the was sprue buried in the investment material are now placed inside an oven and heated up to 1200 degrees F. This step is using the well known lost wax process. At this time, the plastic fingernail tip, the wax in the nail bed and the wax sprue with the upper and lower stems are melted leaving a negative fingernail mold of the artificial fingernail and the sprue inside the investment material.

The negative fingernail mold, while still hot, is now placed inside a centrifugal force casting machine. A selected precious material or alloy is now melted and placed into the casting machine. When the centrifugal force casting machine is turned on, the melted metal is thrown inside the negative fingernail mold forming a positive metal fingernail and metal sprue.

Using a grinder or cutting tool, the investment material of the negative fingernail mold is cut away and the metal fingernail and metal sprue are removed. The stem of the metal sprue secured to the center portion of the metal fingernail is then cut. The completed custom fit metal fingernail is now polished and shined for applying to the top of the user's fingernail.

These and other objects of the present invention will become apparent to those familiar with the making and using of false fingernails when reviewing the following detailed description, showing novel construction, combination, and elements as herein described, and more particularly defined by the claims, it being understood that changes in the embodiments to the herein disclosed invention are meant to be included as coming within the scope of the claims, except insofar as they may be precluded by the prior art.

BRIEF DESCRIPTION OF THE DRAWINGS

The accompanying drawings illustrate complete preferred embodiments in the present invention according to the best modes presently devised for the practical application of the principles thereof, and in which.

DESCRIPTION OF THE PREFERRED EMBODIMENTS

Figure 1:
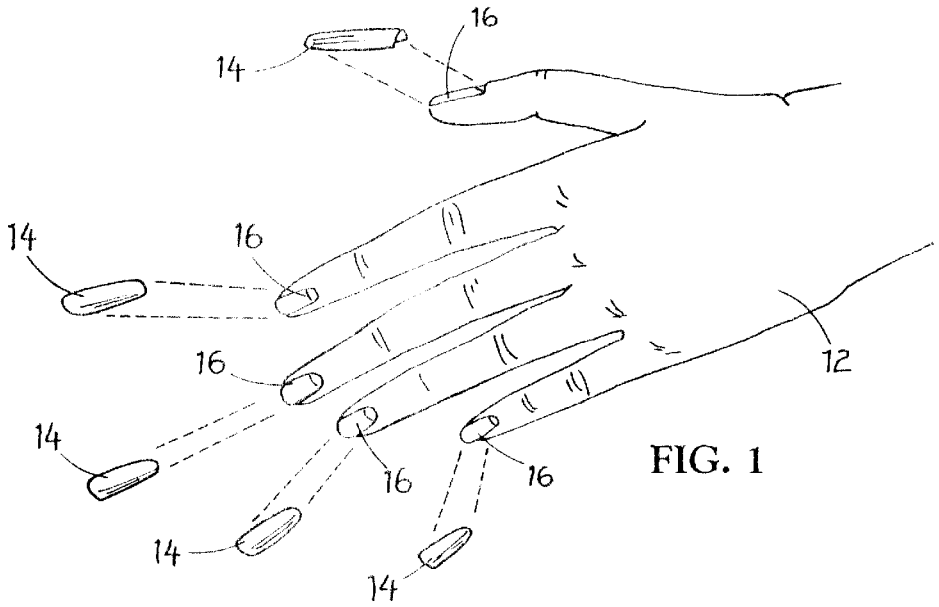
FIG. 1 is a perspective view of a portion of a left hand of a user of the subject invention. In this drawing, five of the custom fit metal fingernails are in position for removable attachment to the top of the user's fingernails.

In FIG. 1, a perspective view of a left hand 12 of a user of the subject invention is shown. In this drawing, the subject custom fit metal false fingernails 14 are shown in position for removable attachment to the top of the user's fingernails 16.

Figure 2:
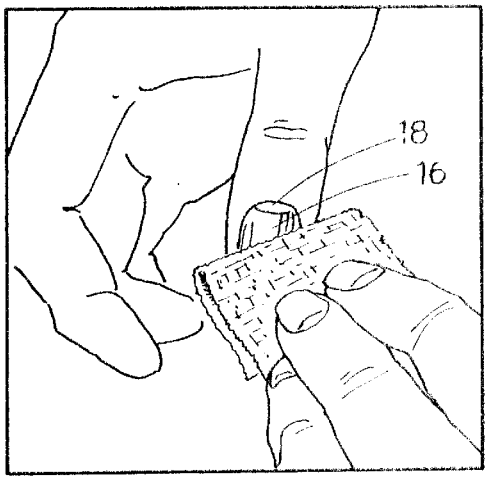
FIG. 2 is a perspective view illustrating the cleaning of a fingernail and nail bed of the thumb of the user.

In FIG. 2, a perspective view of the cleaning of one of the fingernails 16 and a nail bed 18 of the thumb of the user is illustrated.

Figure 3:
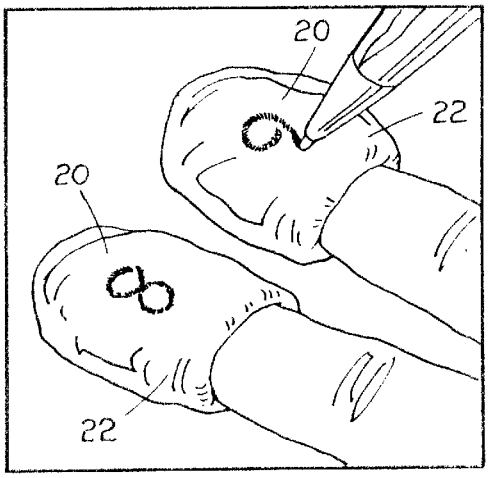
FIG. 3 is a perspective view of two of the fingers of the user receiving thermoplastic impression material impression material poured over and around the ends of the two fingers and including the fingernails and the nail beds. The impression material is used to form a negative finger impression. Each negative finger impression is numbered, should additional metal fingernails be required in the future for fingernails that are lost, misplaced, damaged, etc.

In FIG. 3, a perspective view of two of the fingers of the user receiving thermoplastic impression material 20 is illustrated. In this view, the impression material 20 is poured over and around the ends of the two fingers and including the fingernails 16 and nail beds 18. The impression material 20 is used to form a negative finger impression 22. Each negative finger impression 22 is numbered, for example numbers 8 and 9 as shown. The numbering of the impressions is none should additional metal fingernails 14 be required at a later date for fingernails that are lost, misplaced, damaged, etc.

Figure 4:
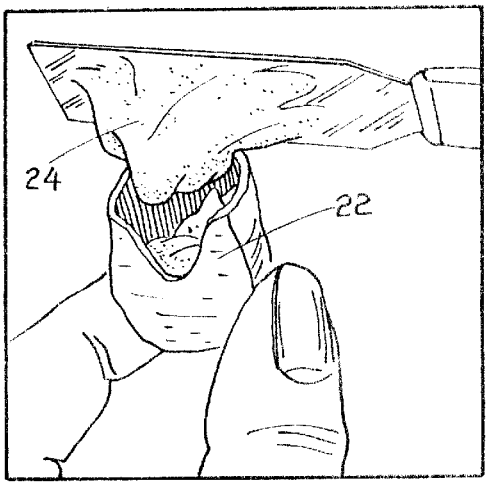
FIG. 4 is a perspective view illustrating a high heat dental crown and bridge investment material being poured into one of the negative finger impressions.

In FIG. 4, a perspective view illustrating a high heat dental crown and bridge investment material 24 is shown being poured into one of the negative finger impressions 22. The investment material 24, after being poured, is allowed to set-up for an hour or more.

Figure 5:
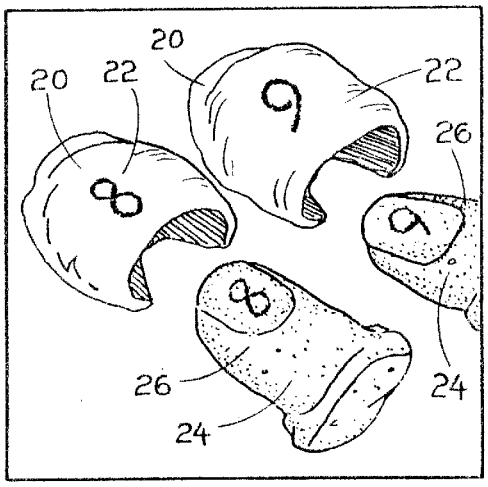
FIG. 5 is a perspective view of two positive investment impressions being removed from the pair of negative finger impression.

In FIG. 5, a perspective view of two positive investment impressions 26 is shown being removed from a pair of negative finger impressions 22.

Figure 6:
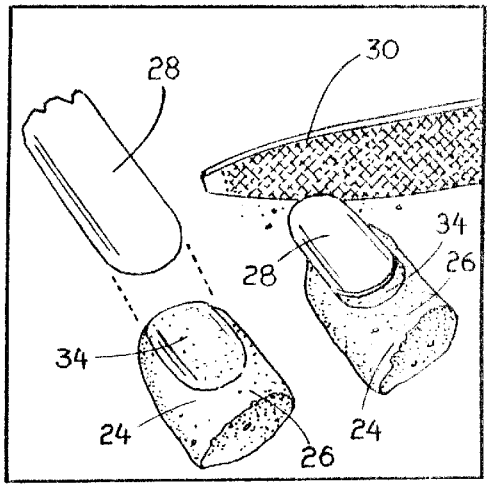
FIG. 6 is a perspective view of the two positive investment impressions with one impression about to receive a plastic false fingernail. The second impression has received a plastic false fingernail and it is being trimmed and shaped according to the user's instructions.

In FIG. 6, a perspective view of the two positive investment impressions 26 shown in FIG. 5 are illustrated with one impression 26 about to receive a plastic false fingernail tip 28 thereon. The second impression 26 has received another plastic false fingernail tip 28, which is attached using a selected adhesive. The second fingernail 28 is shown being trimmed and shaped using a nail file 30 and according to the user's instructions.

Figure 7:
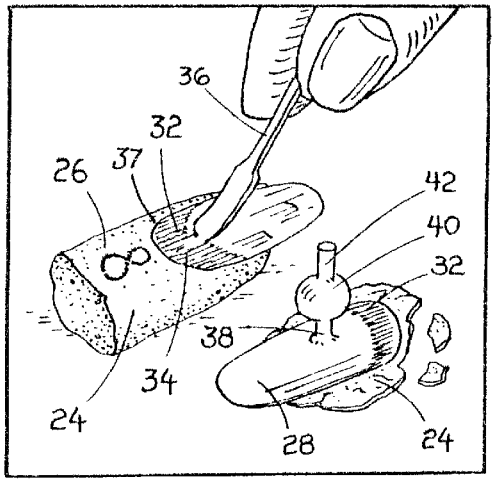
FIG. 7 is a perspective view of wax being filled into a nail bed on one of the positive investment impressions. On another impression, a lower stem of a wax sprue is attached to a center portion of the plastic false fingernail.

In FIG. 7, a perspective view of wax 32 being filled into an impression of a nail bed 34 on one of the positive investment impressions 26 is shown. The wax 32 is spread and smoothed using a wax spreading tool 36 in a fingernail bed 34 and next to an impression of a cuticle 37. This step covers an area in the nail bed 34 not covered by the plastic fingernail top 28. An arbor band is now used to remove excess investment material 24 around the fingernail bed 34 and the plastic fingernail tip 28. The arbor band is not shown in the drawings.

Also shown in this drawing is another positive investment impression 24 wherein an end of a lower stem 38 of a wax sprue 40 is attached to a center portion of the plastic false fingernail tip 28. The end of the lower stem 38 is attached by melting a portion of the wax stem 38.

Figure 8:
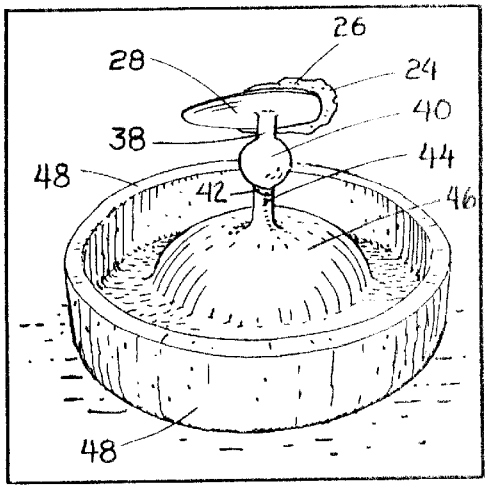
FIG. 8 is a perspective view of an end of an upper stem of the wax sprue inserted into a small opening in the top of a hollow dome shaped cap in a center of a rubber ring former.

In FIG. 8, a perspective view of an end of an upper stem 42 of the wax strue 40 is shown and inserted into a small opening 44 in the top of a hollow dome shaped cap 46 in a center of a rubber ring former 48.

Figure 9:
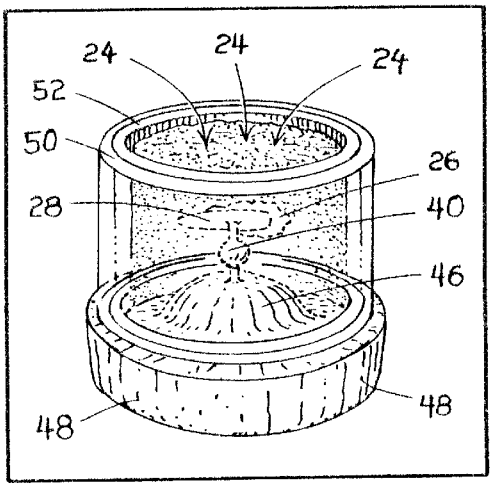
FIG. 9 is a perspective view of a metal ring with a ceramic liner placed on the ring former surrounding the cap and the wax sprue attached to the plastic finger tip, the fingernail bed and the remaining investment material. In this drawing, additional investment material is shown poured inside the metal ring and the ceramic liner.

In FIG. 9, a perspective view of a metal ring 50, with a ceramic liner 52, is shown and placed on the ring former 48. The metal ring 50 surrounds the dome shaped cap 46 and the wax sprue 40 attached to the plastic finger tip 28 and the surrounding investment material impression 26. In this drawing, additional investment material 24 is shown being poured, as indicated by arrows, inside the metal ring 50 and the ceramic liner 52.

Figure 10:
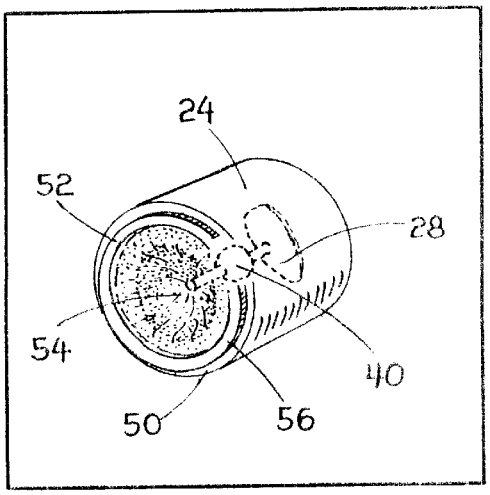
FIG. 10 is a perspective view of investment material with the rubber ring former removed from the metal ring leaving a cone shaped cavity formed by the dome shaped cap in an end of the investment material. The investment material is now placed in an oven for practicing the lost wax process.

In FIG. 10, a perspective view of the investment material 24 is shown after being set-up with the rubber ring former 48 removed from the metal ring 50 and leaving a cone shaped cavity 54, formed by the dome shaped cap 46, in an end 56 of the investment material 24. The metal ring 50 with ceramic liner 52, the investment material 24 with the plastic fingernail tip 28 and the wax sprue 40 buried in the investment material are now placed inside an oven and heated up to 1200 degrees F. This step uses the well known lost wax process. At this time, the plastic fingernail tips 28, the wax 32 in the nail bed 34 and the wax sprue 40 with upper and lower stems 42 and 38 are melted leaving a negative fingernail mold of the artificial fingernail and sprue inside the investment material. The negative fingernail mold is not shown in the drawings.

The negative fingernail mold, after being removed from the oven and while still hot, is now placed inside a centrifugal force casting machine. A selected precious metal or alloy is now melted and placed into the casting machine. When the centrifugal force casting machine is turned on, the melted metal is thrown by centrifugal force inside the negative fingernail mold thereby forming a positive metal fingernail 14 and a metal sprue 58. The centrifugal force casting machine is not shown in the drawings.

Using a grinder or cutting tool, the investment material 24 of the negative fingernail mold is now cut away and the metal fingernail and the metal sprue 58 are removed.

Figure 11:
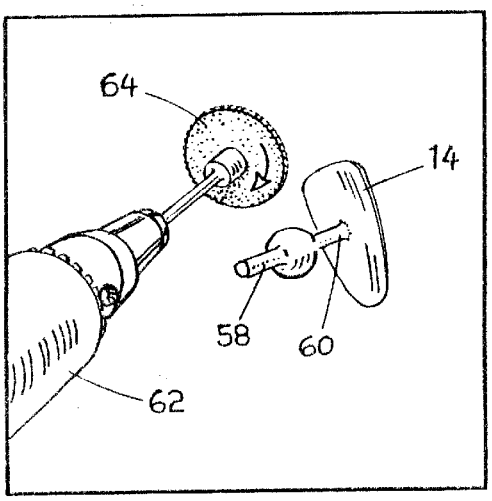
FIG. 11 is a perspective view of a newly formed metal fingernail and metal sprue removed from the investment material. The stem of the metal sprue secured to the center of the metal fingernail is shown be cut off, using an electric grinder or the like, and removed from the completed metal fingernail.

In FIG. 11, a perspective view of the newly formed metal fingernail 14 and metal sprue 58 are illustrated and removed from the investment material 24. A lower metal stem 60 of the metal sprue 58 secured to the center portion of the metal fingernail 14 is shown in this drawing being cut off, using an electric grinder 62 with grinding wheel 64. The completed custom fit metal fingernail 14 is now polished and shined for applying to the top of the user's fingernail 16 as shown in FIG. 1.

While the invention has been particularly shown, described and illustrated in detail with reference to the preferred embodiments and modifications thereof, it should be understood by those skilled in the art that equivalent changes in form and detail may be made therein without departing from the true spirit and scope of the invention as claimed except as precluded by the prior art.

The embodiments of the invention for which as exclusive privilege and property right is claimed are defined as follows:

1. A process for fabricating a custom fit removable and reusable false metal fingernail for a finger of the user of the false metal fingernail, the false fingernail may be made of a precious metal as gold or silver or a non-precious metal alloy, the steps comprising:

pouring an impression material around an end of the finger and forming a negative finger impression of a fingernail and a nail bed;

filling the negative finger impression with an investment material to form a positive finger investment impression;

attaching an artificial plastic fingernail on the positive finger investment impression;

placing the positive finger investment impression with plastic fingernail inside an oven and melting the plastic fingernail and leaving a negative fingernail mold; and filing the negative fingernail mold with a melted metal to form the completed false metal fingernail.

2. The process as described in claim 1 wherein the step of attaching the plastic fingernail to the positive finger investment impression includes a step of trimming and shaping the false plastic fingernail to a user's instructions.

3. The process as described in claim 1 wherein the step of attaching the plastic fingernail to the positive finger investment impression includes a step of spreading wax in the nail bed next to the cuticle for covering an area in the nail bed not covered by the plastic fingernail.

4. The process as described in claim 1 further including a step of placing the positive finger investment impression with plastic fingernail inside a metal ring with ceramic liner prior to placing the positive finger investment impression with plastic fingernail in the oven.

5. The process as described in claim 1 wherein the negative fingernail mold is filed with melted metal using a centrifugal force machine.

6. The process as described in claim 1 further including a step of polishing the metal fingernail after the completed false metal fingernail is formed.

7. A process for fabricating a custom fit removable and reusable false metal fingernail for a finger of the user of the false metal fingernail, the false fingernail may be made of a precious metal as gold or silver or a non-precious metal alloy, the steps comprising:

pouring an impression material around an end of the finger and forming a negative finger impression of a fingernail and a nail bed;

filling the negative finger impression with an investment material to form a positive finger investment impression with an impression of the fingernail and nail bed;

attaching an artificial plastic fingernail on the fingernail impression of the positive finger investment impression;

placing the positive finger investment impression with plastic fingernail inside an oven and melting the plastic fingernail and leaving a negative fingernail mold; and filing the negative fingernail mold, using a centrifugal force machine, with a melted metal to form the completed false metal fingernail.

8. The process as described in claim 7 wherein the step of attaching the plastic fingernail to the positive finger investment impression includes a step of trimming and shaping the false plastic fingernail to a user's instructions.

9. The process as described in claim 7 wherein the step of attaching the plastic fingernail to the positive finger investment impression includes a step of spreading wax in the nail bed next to the cuticle for covering an area in the nail bed not covered by the plastic fingernail.

10. The process as described in claim 9 further including a step of placing the positive finger investment impression with plastic fingernail and wax in the nail bed inside a metal ring with ceramic liner prior to placing the positive finger investment impression with plastic fingernail and wax in the nail in the oven.

11. The process as described in claim 7 further including a step of polishing the metal fingernail after the completed false metal fingernail is formed.

12. A process for fabricating a custom fit removable and reusable false metal fingernail for a finger of the user of the false metal fingernail, the false fingernail may be made of a precious metal as gold or silver or a non-precious metal alloy, the steps comprising:

pouring a thermoplastic impression material around an end of the finger and forming a negative finger impression of a fingernail and a nail bed;

filling the negative finger impression with an investment material to form a positive finger investment impression;

attaching an artificial plastic fingernail tip on the investment impression;

attaching one end of a lower stem of a wax sprue to the plastic fingernail tip;

inserting one end of an upper stem of the wax sprue in the top of a hollow dome shaped cap in a rubber ring former;

placing a metal ring with a ceramic liner on the ring former surrounding the cap and the wax sprue attached to the plastic finger tip;

placing the metal ring, the investment material and with the plastic fingernail tip and the wax sprue buried in the investment material inside an oven;

melting the plastic fingernail tip, the wax in the nail bed and the wax sprue leaving a negative fingernail mold; and filing the negative fingernail mold, using a centrifugal force machine, with a melted metal to form the completed false metal fingernail.

13. The process as described in claim 12 wherein the step of attaching the plastic fingernail to the positive finger investment impression includes a step of trimming and shaping the false plastic fingernail to a user's instructions.

14. The process as described in claim 12 wherein the step of attaching the plastic fingernail to the positive finger investment impression includes a step of spreading and smoothing wax in the nail bed next to the cuticle for covering an area in the nail bed not covered by the plastic fingernail.

15. The process as described in claim 12 further including a step of pouring additional investment material inside the metal ring and the ceramic liner prior to placing the metal ring, the investment material with the plastic fingernail tip and wax sprue in the oven.

* * * * *